United States Patent [19]

Manghirmalani, deceased

[11] 4,252,435

[45] Feb. 24, 1981

[54] CLEANING SUBSYSTEM FOR A XEROGRAPHIC REPRODUCTION MACHINE

[75] Inventor: Arjan T. Manghirmalani, deceased, late of Centerville, Ohio, by Joan M. Manghirmalani, executrix

[73] Assignee: Xerox Corporation, Stamford, Conn.

[21] Appl. No.: 57,869

[22] Filed: Jul. 16, 1979

[51] Int. Cl.[3] ..... G03G 21/00

[52] U.S. Cl. ..... 355/15; 15/256.52; 118/652

[58] Field of Search ..... 355/15; 430/125; 118/652; 15/256.5, 256.51, 256.52, 256.53

[56] References Cited

U.S. PATENT DOCUMENTS

| | | | |
|---|---|---|---|
| 3,942,889 | 3/1976 | Kurita et al. | 355/15 |
| 3,955,235 | 5/1976 | Meyer | 355/15 X |
| 4,181,425 | 1/1980 | Higaya et al. | 355/15 |

*Primary Examiner*—Richard L. Moses
*Attorney, Agent, or Firm*—Earl T. Reichert

[57] ABSTRACT

To clean toner, particularly magnetic toner, from a photoreceptor, an improved cleaning subsystem includes a foam roll cleaner in contact with and mounted to rotate in a tangential direction opposite to that of the photoreceptor. The foam roll cleaner is mounted within a housing, and a baffle extends upwardly at an angle from the housing into the pre-nip zone between the photoreceptor and the cleaner in extremely close proximity to both the photoreceptor and to where the cleaner initially contacts the photoreceptor during rotation of the cleaner. This arrangement generates a positive pressure within the housing and to relieve this positive pressure without expelling any toner from the housing, filtered openings are provided in the housing. To discharge or release toner from the foam roll cleaner during operation of the cleaning subsystem, the cleaner is vibrated. Any magnetic toner accumulating on the interior surfaces of the housing are moved or conveyed downwardly into the bottom portion of the housing by magnetic conveyors located on the exterior of the housing.

10 Claims, 3 Drawing Figures

CLEANING SUBSYSTEM FOR A XEROGRAPHIC REPRODUCTION MACHINE

BACKGROUND OF THE INVENTION

The present invention relates to an improved cleaning subsystem for a xerographic reproduction machine, but more particularly to a cleaning subsystem which does not require a vacuum exhaust mechanism for the subsystem housing.

With the introduction of small copiers for the low volume end of the copier market, it has become increasingly important to minimize both the cost and the complexity of the copiers. Larger copiers and duplicators presently use cleaning subsystems which require the use of a vacuum source which is connected to the subsystem housing by a conduit. If this vacuum exhaust mechanism could be eliminated, the complexity of the cleaning subsystem as well as the size and cost thereof could be substantially reduced. Consequently, what is needed is a cleaning subsystem which does not require the use of a complicated vacuum exhaust mechanism, which subsystem would also be lower in cost and occupy less space within the copier.

SUMMARY OF THE INVENTION

A primar object of the present invention is to reduce the cost, size and complexity of a cleaning subsystem for a small copier by eliminating the need for a vacuum exhaust mechanism. This cleaning subsystem uses a rotating foam roll cleaner to clean a photoreceptor, the cleaner being enclosed within a housing located adjacent to the photoreceptor. Pivotally connected to the housing is a baffle which has Teflon spacers on the inboard and outboard ends of the edge of the baffle, which spacers ride on the photoreceptor to keep the edge precisely spaced from the photoreceptor. The edge of the baffle is precisely located with respect to the area where the foam roll cleaner contacts the photoreceptor. As a result of the foam roll contacting the photoreceptor, a pumping action is produced which causes air to be squeezed out of the pores of the foam roll which results in a positive pressure being generated within the cleaning subsystem housing. To relieve the housing of this positive pressure, openings are located in the inboard and outboard ends of the housing of the cleaning subsystem, which openings have low impedance filters thereover to allow the expulsion of air while retaining the toner within the housing. Toner removed from the photoreceptor by the foam roll is caused to be discharged from the foam roll by vibrating the foam roll during its rotation. The discharged toner falls into the bottom of the cleaning subsystem housing where it is periodically removed therefrom by an auger or any other suitable means. Since the present invention has been found to be particularly effective with magnetic toners, magnetic conveyor means are also provided on the sides of the housing to move any toner which has been deposited on the interior walls of the housing to the bottom thereof.

DETAILED DESCRIPTION OF THE INVENTION

Figure 1:
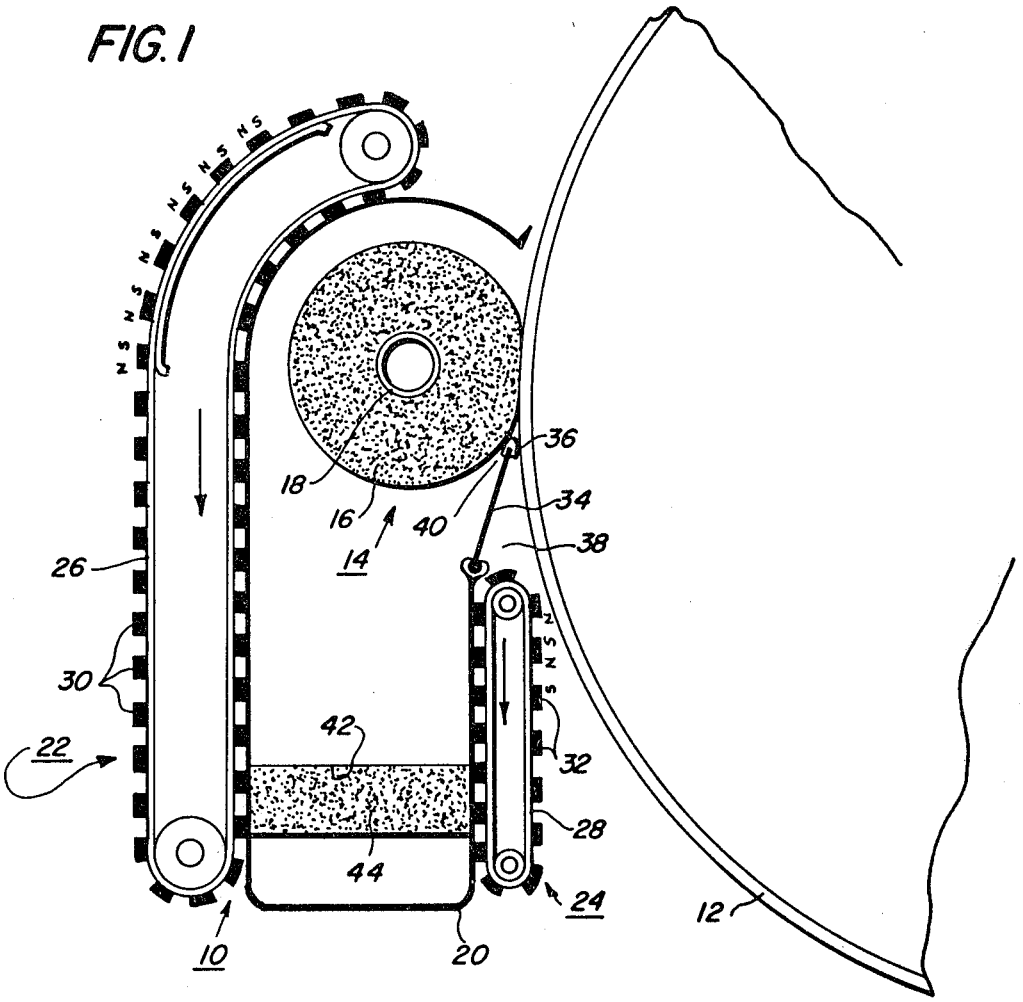
FIG. 1 is a schematic sectional view of a preferred embodiment of the present invention mounted adjacent to the photoreceptor which is to be cleaned.

Referring to FIG. 1, the operation of the present invention will now be described in detail. A cleaning subsystem 10 is mounted adjacent to a photoreceptor 12 which is to be cleaned. The cleaning subsystem 10 includes a foam roll cleaner 14 which is mounted to contact the photoreceptor and rotate in a direction which is tangentially opposite to that of the photoreceptor. As can be seen, the foam roll cleaner includes a foam roll 16 which is mounted on an aluminum core 18. Toner removed from the photoreceptor 10 by the foam roll cleaner 14 is caused to be discharged or released from the cleaner into a housing 20 by a mechanism which will be described in more detail later. Since the present invention has been found to be particularly effective with magnetic toners, magnetic conveyors are located on the exterior of the housing to move any toner which may accumulate on the interior walls of the housing to the bottom thereof. Magnetic conveyors 22 and 24 each has a rotatably mounted canvass belt 26 and 28 respectively, and mounted around the belts are a plurality of magnets 30 and 32 respectively, which magnets are mounted on the belts so that any two adjacent magnets have opposite poles facing each other.

Figure 2:
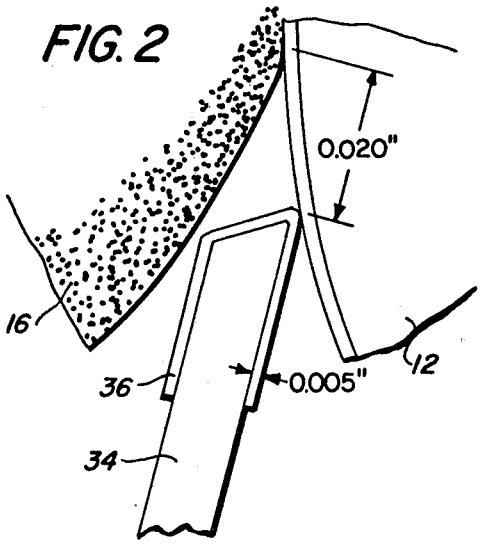
FIG. 2 is an enlarged view showing the precise location of the edge of the baffle with respect to the foam roll cleaner and photoreceptor.

Rotatably mounted to the housing 20 is a baffle 34 having Teflon spacers 36 located on the extreme inboard and outboard ends of the baffle. It has been found that the precise spacing of the tip or end of the baffle 34 in the pre-nip zone with respect to the foam roll cleaner 14 and photoreceptor 12 is critical to the operation of the present invention. Optimum performance was achieved when the Teflon tips were approximately 0.005" to 0.010" thick and the end of the tip was spaced approximately 0.020" from where the foam roll cleaner 14 initially contacts the photoreceptor (see FIG. 2). In this way, the end of the baffle 34 is kept 0.005" to 0.010" away from the photoreceptor during operation of the cleaning subsystem. It was found that any larger gap produced toner clouds in region 38 between the photoreceptor 12 and the baffle 34, which resulted in toner redeposition onto the photoreceptor 12. During operation of the present cleaning subsystem, a positive pressure, i.e., a pressure above atmospheric pressure, is produced within the housing 20 and this pressure was measured in region 40 between the foam roll cleaner 14 and the baffle 34. To relieve the interior of the housing 20 of this positive pressure, openings 42 were formed on the inboard and outboard end of the housing 16, which openings were covered by low impedance porous filters 44. These filters allow air to be expelled from within the housing while retaining the toner inside where it is periodically removed by any suitable means.

Figure 3:
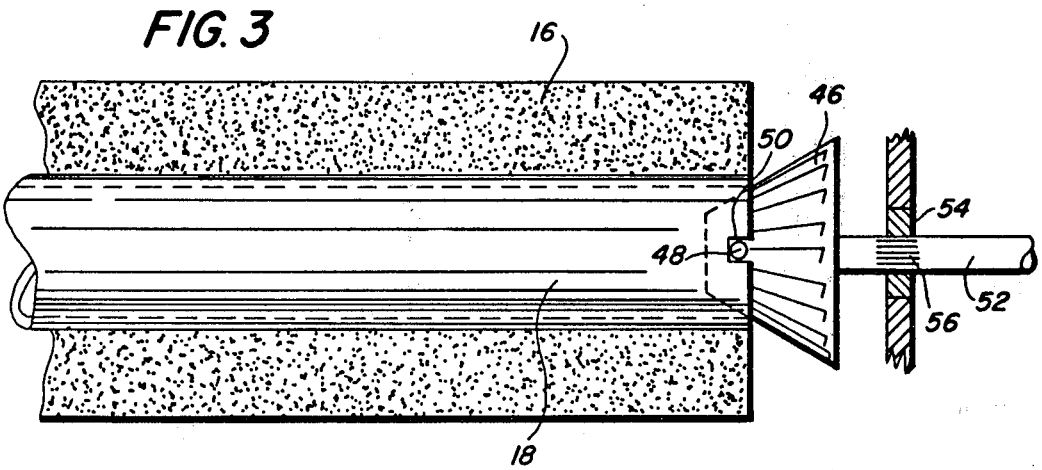
FIG. 3 is a view, partially in section, showing one end of the foam roll cleaner and how it is mounted on a shaft, and showing the means for causing the foam roll cleaner to be vibrated during rotation.

Referring to FIG. 3, the specific mechanism for causing the toner to be released from the foam roll cleaner 14 during operation will now be described. The aluminum core 18 of the foam roll cleaner is mounted onto a splined tapered member 46 which has a pin 48 extending therethrough, which pin mates with a groove 50 in the end of the aluminum core. The tapered member 46 is mounted to a shaft 52 which is driven by a pulley and belt system or any other suitable driving mechanism. The shaft 50 is rotatably supported by a plurality of bearings 52. To cause the foam roll cleaner 14 to vibrate during operation so as to release the toner thereon, a plurality of serrations on ridges 56 are cut into the shaft 50 where the shaft contacts the bearings 54. As stated above, this cleaning subsystem has been found to be particularly effective on small copiers using magnetic toners. It is believed that the reason for this is that magnetic toners are heavier in mass and thus are more easily discharged from the foam roll cleaner 14 when the latter is vibrated during operation of the cleaning system. In addition, when using magnetic toners, any toner which accumulates on the interior of the housing can be easily moved to the lower or bottom portion thereof by the magnetic conveyors 22 and 24 described above.

During tests of the present invention, the photoreceptor 12 was rotating at a speed of 15 inches per second and had an outside diameter of 9½ inches. The foam roll cleaner 14 was rotating at a speed of between 600 and 800 rpm and had an outside diameter of 2½ inches. As far as could be determined, the interference of the foam roll cleaner 14 with the photoreceptor did not appear to be critical as long as the foam roll cleaner contacted the photoreceptor all along the length of the cleaner. During tests, however, a 0.020" to 0.030" interference was generally maintained. Both the foam material used for the foam roll cleaner 14 and for the filter 44 was made from foam material within the range of 60 to 100 pores per inch. The gap between the upper end of the housing 20 and the photoreceptor 12 was ⅜".

While the invention has been described with reference to the structure disclosed, it is not confined to the details set forth, but is intended to cover such modifications or changes as may come within the scope of the following claims.

What is claimed is:

1. An improved cleaning subsystem for cleaning toner from a photoreceptor without the use of a vacuum exhaust mechanism comprising:

(a) a housing located adjacent to the photoreceptor;

(b) means for creating a positive pressure within the housing during operation of the cleaning subsystem, the pressure creating means including a foam roll cleaner in contact with and mounted to rotate in a tangential direction opposite to that of the photoreceptor, and a baffle pivotally mounted to the housing and extending upwardly at an angle from the housing into the pre-nip zone between the photoreceptor and cleaner to where the cleaner initially contacts the photoreceptor during rotation of the cleaner, the baffle extending to within approximately 0.020 inches of where the foam roll cleaner initially contacts the photoreceptor during rotation of the cleaner;

(c) spacer means for keeping the baffle to within 0.005 inches to 0.010 inches from the photoreceptor, and (d) means for relieving the positive pressure from within the housing while simultaneously preventing any of the toner cleaned from the photoreceptor from escaping from within the housing.

2. An improved cleaning subsystem as set forth in claim 1 which further includes means for vibrating the foam cleaner during rotation of the latter.

3. An improved cleaning subsystem for cleaning magnetic toner from a photoreceptor without the use of a vacuum exhaust mechanism comprising:

(a) a housing located adjacent to the photoreceptor;

(b) means for creating a positive pressure within the housing during operation of the cleaning subsystem, the pressure creating means including a foam roll cleaner in contact with and mounted to rotate in a tangential direction opposite to that of the photoreceptor, and a baffle pivotally mounted to the housing and extending upwardly at an angle from the housing into the pre-nip zone between the photoreceptor and cleaner to where the cleaner initially contacts the photoreceptor during rotation of the cleaner, the baffle extending to within approximately 0.020 inches of where the foam roll cleaner initially contacts the photoreceptor during rotation of the cleaner;

(c) spacer means for keeping the baffle to within 0.005 inches to 0.010 inches from the photoreceptor;

(d) means for relieving the positive pressure from within the housing while simultaneously preventing any of the toner cleaned from the photoreceptor from escaping from within the housing; and (e) means for conveying any of the magnetic toner which has accumulated on a vertical wall of the housing to the bottom portion of the housing.

4. An improved cleaning subsystem as set forth in claim 3 which further includes means for vibrating the foam roll cleaner during rotation of the latter.

5. An improved cleaning subsystem for cleaning toner from a photoreceptor without the use of a vacuum exhaust mechanism comprising:

(a) a housing located adjacent to the photoreceptor;

(b) means including a foam roll cleaner for creating a positive pressure within the housing during operation of the cleaning subsystem;

(c) means for vibrating the foam roll cleaner during rotation of the latter; and (d) means for relieving the positive pressure from within the housing while simultaneously preventing any of the toner cleaned from the photoreceptor from escaping from within the housing.

6. An improved cleaning subsystem for cleaning toner from a photoreceptor without the use of a vacuum exhaust mechanism comprising:

(a) a housing located adjacent to the photoreceptor;

(b) means for creating a positive pressure within the housing during operation of the cleaning subsystem, the pressure creating means including a foam roll cleaner in contact with and mounted to rotate in a tangential direction opposite to that of the photoreceptor, and a baffle extending upwardly at an angle from the housing into the pre-nip zone between the photoreceptor and cleaner in extremely close proximity to both the photoreceptor and to where the cleaner initially contacts the photoreceptor during rotation of the cleaner;

(c) means for vibrating the foam roll cleaner during rotation of the latter; and (d) means for relieving the positive pressure from within the housing while simultaneously preventing any of the toner cleaned from the photoreceptor from escaping from within the housing.

7. An improved cleaning subsystem for cleaning toner from the photoreceptor without the use of a vacuum exhaust mechanism comprising:

(a) a housing located adjacent to the photoreceptor;

(b) means for creating a positive pressure within the housing during operation of the cleaning subsystem, the pressure creating means including a foam roll cleaner in contact with and mounted to rotate in a tangential direction opposite to that of the photoreceptor, and a baffle extending upwardly at an angle from the housing into the pre-nip zone between the photoreceptor and cleaner to where the cleaner initially contacts the photoreceptor during rotation of the cleaner, the baffle extending to within 0.005 inches to 0.010 inches of the photoreceptor and to within approximately 0.020 inches of where the foam roll cleaner initially contacts the photoreceptor during rotation of the cleaner;

(c) means for vibrating the foam roll cleaner during rotation of the latter; and (d) means for relieving the positive pressure from within the housing while simultaneously preventing any of the toner cleaned from the photoreceptor from escaping from within the housing.

8. An improved cleaning subsystem for cleaning magnetic toner from a photoreceptor without the use of a vacuum exhaust mechanism comprising:

(a) a housing located adacent to the photoreceptor;

(b) means for creating a positive pressure within the housing during operation of the cleaning subsystem, the pressure creating means including a foam roll cleaner in contact with and mounted to rotate in a tangential direction opposite to that of the photoreceptor, and a baffle extending upwardly at an angle from the housing into the pre-nip zone between the photoreceptor and cleaner to where the cleaner initially contacts the photoreceptor during rotation of the cleaner, the baffle extending to within 0.005 inches to 0.010 inches of the photoreceptor and to within approximately 0.020 inches of where the foam roll cleaner initially contacts the photoreceptor during rotation of the cleaner;

(c) means for vibrating the foam roll cleaner during rotation of the latter;

(d) means for relieving the positive pressure from within the housing while simultaneously preventing any of the toner cleaned from the photoreceptor from escaping from within the housing; and (e) means for conveying any of the magnetic toner which has accumulated on a vertical wall of the housing to the bottom portion of the housing.

9. An improved cleaning subsystem for cleaning toner from a photoreceptor without the use of a vacuum exhaust mechanism comprising:

(a) a housing located adjacent to the photoreceptor;

(b) means for creating a positive pressure within the housing during operation of the cleaning subsystem, the pressure creating means including a foam roll cleaner in contact with and mounted to rotate in a tangential direction opposite to that of the photoreceptor, and a baffle extending from the housing into the pre-nip zone between the photoreceptor and cleaner to where the cleaner initially contacts the photoreceptor during rotation of the cleaner, the baffle extending to within approximately 0.005 inches to 0.010 inches of the photoreceptor and to within approximately 0.020 inches of where the foam roll cleaner initially contacts the photoreceptor during rotation of the cleaner; and (c) means for relieving the positive pressure from within the housing while simultaneously preventing any of the toner cleaned from the photoreceptor from escaping from within the housing.

10. An improved cleaning subsystem as set forth in claim 9 wherein the toner is magnetic and further including magnetic means for conveying any magnetic toner which has accumulated on a vertical wall of the housing to the bottom portion of the housing.

* * * * *